United States Patent [19]

Lawrence

[11] Patent Number: 5,058,546

[45] Date of Patent: Oct. 22, 1991

[54] ENGINE AIR PUMP WITH SPEED DRUM DRIVE

[75] Inventor: Thomas G. Lawrence, Clarkston, Mich.

[73] Assignee: Chrysler Corporation, Highland Park, Mich.

[21] Appl. No.: 667,145

[22] Filed: Mar. 11, 1991

[51] Int. Cl.[5] ..... F02B 77/00

[52] U.S. Cl. ..... 123/198 C; 123/559.1

[58] Field of Search ..... 123/198 R, 198 C, 559.1; 74/206, 721

[56] References Cited

U.S. PATENT DOCUMENTS

| | | | |
|---|---|---|---|
| 2,490,667 | 12/1949 | Boyd, Jr. | 74/721 |
| 2,732,724 | 1/1956 | Tateishi | 74/206 |
| 2,781,667 | 2/1957 | Giskes | 74/206 |
| 3,267,757 | 8/1966 | Hammerand et al. | 74/206 |
| 3,289,487 | 12/1966 | Weedfall | 74/214 |
| 3,971,262 | 7/1976 | Altrogge | 74/214 |
| 4,709,587 | 12/1987 | Fiornascente | 74/721 |

*Primary Examiner*—Noah P. Kamen

*Attorney, Agent, or Firm*—Kenneth H. MacLean

[57] ABSTRACT

For an internal combustion engine with a high speed air pump, an improved frictional drive including a drum drive member having an internal cylindrical track adapted to engage the shaft of a high speed pump in frictional driving relationship. The drum is rotated by an engine crankshaft through a belt/pulley arrangement including a belt tensioning device which tends to bias the drum against the shaft to generate a strong engagement force between the drum and pump shaft.

10 Claims, 2 Drawing Sheets

ENGINE AIR PUMP WITH SPEED DRUM DRIVE

BACKGROUND OF THE INVENTION

1. Field of Invention

The subject invention concerns a high speed air pump for supplying combustion air to an internal combustion engine. More particularly, it relates to a frictional drive mechanism for the air pump for generating a high step-up speed ratio so that the pump is rotated at many times the input speed.

2. Description of the Related Art

In the internal combustion engine art, accessory components are typically driven by the crankshaft of the engine through belts which pass about pulleys on the crankshaft and on a shaft of an accessory. With such a belt drive it is relatively easy to step-up the rotation speed of the accessory shaft using differential sized pulleys. Typically, this is sufficient to step-up rotational speeds by fairly low ratios, such as 2:1 for example. however, when higher step-up ratios are desired, it is not considered possible using differential sized pulleys alone.

The subject engine air pump is a high speed, turbine type pump which can require a rotational speed about 16 times the engine crankshaft speed to be effective. With such a ratio, an engine idle speed of 750 RPM would produce a pump speed of 12,000 RPM. At an engine speed of 5600 RPM, the pump would rotate at 90,000 RPM. Even if a belt/pulley combination alone could produce this high 16:1 ratio, resultant forces on the belt would prevent using such an arrangement.

A desirable solution to the above identified pump drive problem is to provide a frictional drive mechanism. Of course, there are many examples of various frictional drives known in the prior art. For example, applicant is aware of the following prior U.S. Patents which use a friction drive: U.S. Pat. No. 2,490,667 to Boyd; U.S. Pat. No. 2,732,724 to Tateishi; U.S. Pat. No. 2,781,667 to Giskes; U.S. Pat. No. 3,267,757 to Hammerrand; U.S. Pat. No. 3,289,487 to Weedfall; and U.S. Pat. No. 3,971,262 to Altrogge. These patents relate to relatively low speed, low torque applications of a friction drive and do not teach the arrangement of components to successfully achieve the results necessary in the engine pump drive which is the subject of this application as will be made clearer hereinafter.

SUMMARY OF THE INVENTION

This application is for a high speed, high torque frictional drive mechanism useful to drive a high speed, turbine type air pump for supplying air to an internal combustion engine. The drive utilizes a relatively large diameter drum member having a cup-shaped configuration defining an internal cylindrical track. The drum member is mounted by an arm so that it is movable relative to a relatively small diameter input shaft of the air pump. The drum member is rotated by the engine crankshaft through a belt and pulley drive which provides a limited step-up in rotation speed for the drum, i.e., a 2:1 ratio for example. A belt tensioning device operates to remove slack in the belt and bias the internal track of the drum against the small shaft of the air pump. This insures a engagement force therebetween so that sufficient frictional drive forces are generated to inhibit significant slippage. In addition, the wrap of the belt about the drum and the mounting arrangement of the drum relative to the shaft is such that with increased engine and thus belt speed the forces on the moving belt tend to move the drum relative to the pump shaft to increase frictional engagement forces.

Advantageous features and further details of the subject improved shaft driving mechanism will be more readily apparent from a reading of the following detailed description of a preferred embodiment, reference being to the accompanying drawings in which the preferred embodiment is illustrated.

IN THE DRAWINGS

FIG. 1 is a partial elevational front view of the an internal combustion engine including the subject air pump and drive mechanism therefore; and FIG. 2 is a partial elevational side view of the engine with the air pump; and FIG. 3 is a sectioned end view of the air pump drive mechanism taken along section line 3—3 in FIG. 1 and looking in the direction of the arrows; and FIG. 4 is a sectioned view of the mechanism taken along section line 4—4 in FIG. 1 and looking in the direction of the arrows; and FIG. 5 is an enlarged partial sectioned view of the frictional contact between the air pump shaft and the drive mechanism taken along section line 5—5 in FIG. 3 and looking in the direction of the arrows; and FIG. 6 is a schematic view of the engine accessory drive system including the subject frictional drive mechanism.

DETAILED DESCRIPTION OF AN EMBODIMENT

Figure 1:
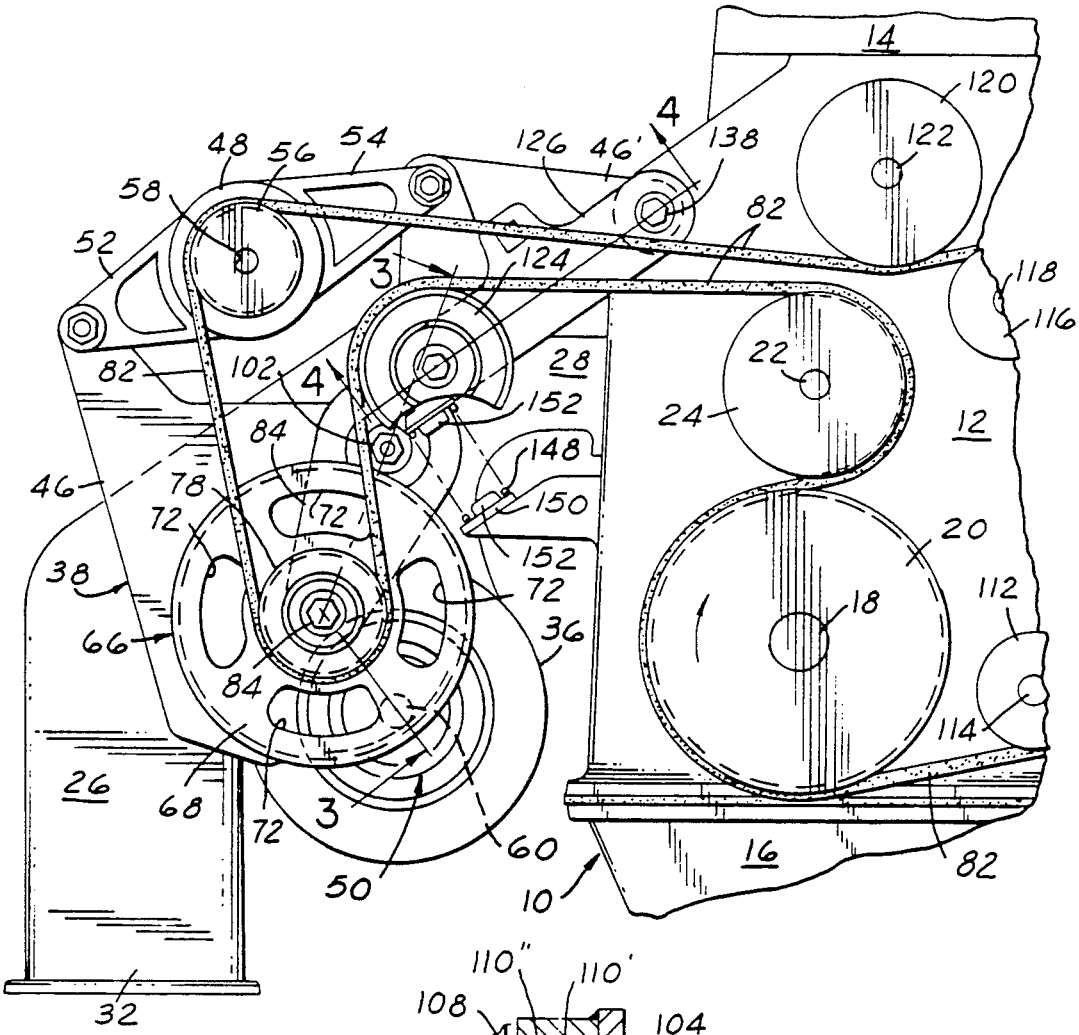
Figure 2:
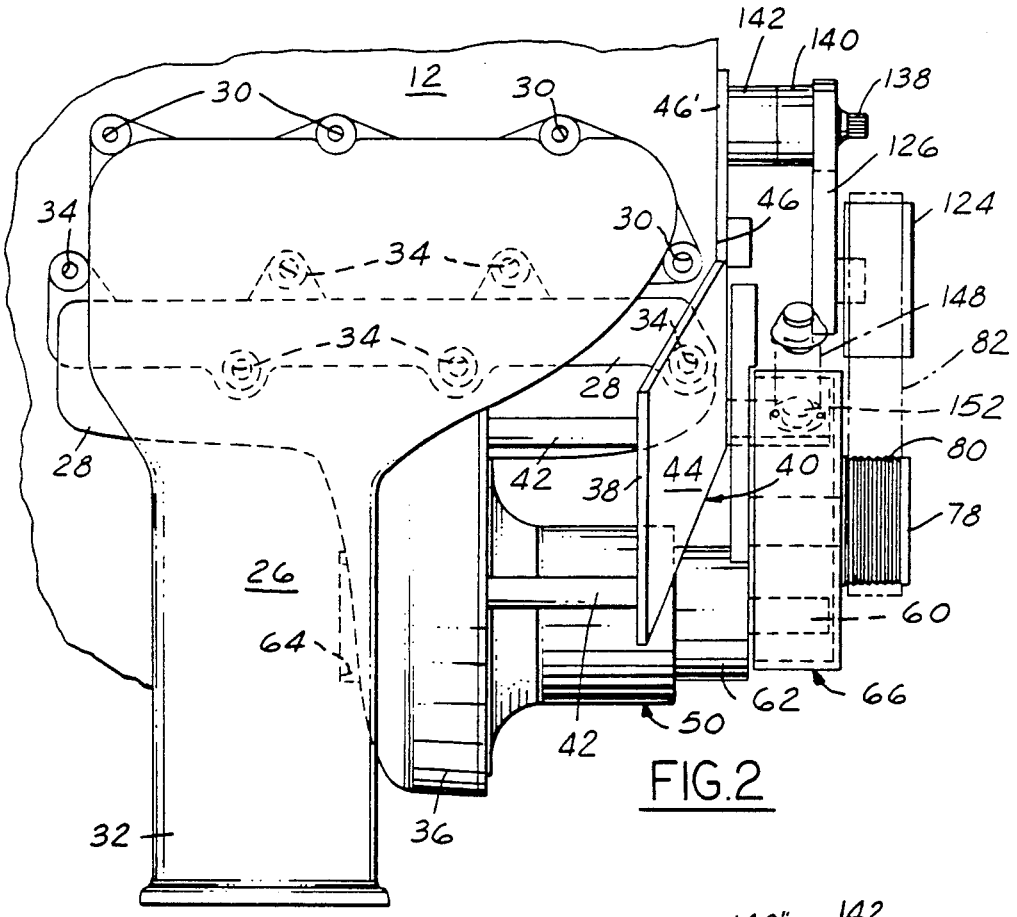

FIGS. 1-2 illustrate an internal combustion engine 10 including a block portion 12, a cylinder head portion 14 and an oil reservoir (oil pan) portion 16. In FIG. 1, a portion of the front end of the engine 10 reveals an external end of a crankshaft 18 on which a relatively large diameter pulley 20 is attached. FIG. 1 also reveals the end of a shaft 22 and pulley 24 for a water pump which is mounted on the engine.

The engine 10 includes a substantially hollow exhaust manifold 26 to discharge combustion products from the combustion chambers of the engine and a substantially hollow intake manifold 28 to introduce air to the combustion chambers of the engine. As best revealed in FIG. 2, the exhaust manifold 26 is attached to the block 12. The preferred means of attachment is by fasteners, preferably cap screws (not shown), which extend through openings 30 spaced about the peripheral edge of the manifold. As seen in FIG. 1, the exhaust manifold 26 projects laterally outward from the block 12 and then downward to an outlet end portion 32 which is adapted to be connected to the exhaust system of a vehicle (not shown).

The intake manifold 28, like the exhaust manifold, is attached to engine block 12. The preferred means of attachment is by fasteners, preferably cap screws (not shown), which extend through the openings 34 formed in the manifold and spaced about the peripheral edge where the manifold engages the block 12. As evident from FIGS. 1 and 2, the intake manifold 28 extends slightly laterally outward from block 12 and then projects downward into an air inlet portion and air pump impeller housing 36.

The lower air inlet and impeller housing 36 of the intake manifold 28 is spaced from a flat surface portion 38 of a bracket member 40. A plurality of elongated spacer members 42 extend between the housing 36 and the portion 38 to fix the relationship therebetween while elongated fasteners (not visible) extend axially through the spacer members 42 to attach them together. The bracket member 38 also has an angled portion 44 which connects the portion 38 with a main surface portion 46. As best seen in FIG. 1, the main surface portion 46 of bracket 38 extends outwardly with respect to the manifold portion 36 with one corner portion 46' of it attached to block 12 as seen in FIG. 1. Bracket 38 supports a number of engine components such as an alternator 48 and an air pump housing 50.

The alternator 48 has a pair of laterally extending flanges 52, 54 which are attach to portions of the bracket 38. Like other engine accessories, alternator 48 includes a belt engaging pulley 56 attached to an external end 58 of its shaft.

Figure 3:
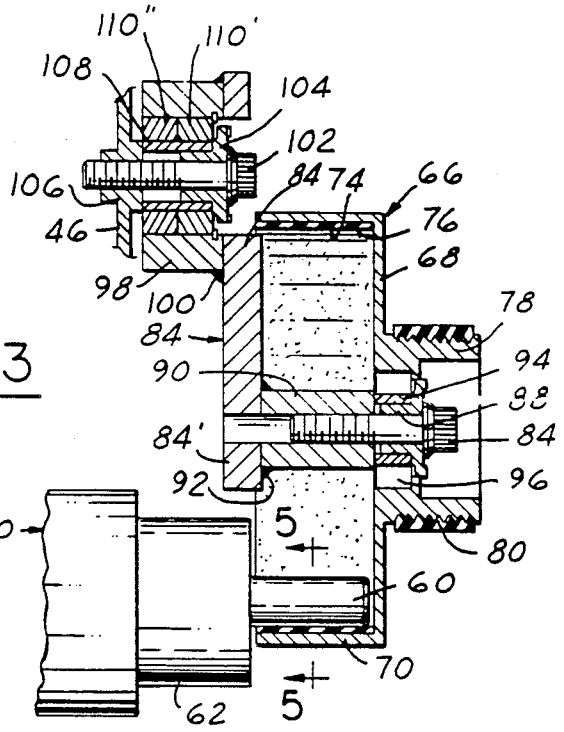
Figure 5:
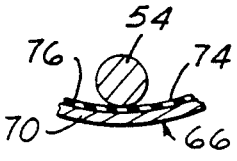

The air pump includes manifold portion 36 and housing 50. It is the same type of pump used in the compressor portion of an automobile turbocharger, namely, a high speed, non-positive displacement turbine. The manifold's air inlet portion 36 forms a housing for an impeller which is mounted on the end of a shaft within the housing. In FIGS. 1-3, an exposed external end portion 60 of the air pump shaft is exposed. The shaft and impeller are mounted for rotation in a bearing support portion 62 of the air pump 50. Air is introduced to the impeller chamber of the air pump through a rearwardly facing inlet opening 64 (see FIG. 2) and is then directed by the vanes of the impeller radially outward to be collected by an annular or scroll shaped air passage (not seen) formed by portion 36. This air passage configuration is common in a vehicle turbocharger.

A turbine type air pump as so far described functions efficiently at relatively high speeds (10,000-90,000 RPM) compared to the normal speeds of internal combustion engines (750-5600 RPM). With a ratio of crankshaft pulley diameter to air pump pulley diameter of 2:1, the rotational speed of an air pump would only be about 1500 RPM at an engine idle of 750 RPM and 11,200 at wide open throttle. Accordingly, with this type air pump, a much higher step-up ratio is necessary than can be obtained using differential pulley diameters alone.

Accordingly, a friction drive mechanism has been designed for the air pump in the subject embodiment. The drive mechanism includes a drum member 66 which is best shown in FIGS. 1 and 3. Drum member 66 has a generally cup-shaped configuration including an end wall portion 68 and an outer cylindrical side wall 70. For lightness, the end wall 68 has openings 72 therethrough. The outer side wall 70 provides an interior track surface 74 against which the external end portion 60 of the air pump's shaft presses. To increase the frictional engagement therebetween, is desirable to provide a thin covering 76 of rubber bonded to the interior surface of the outer wall 70.

It can now be easily understood that a large increase or step-up in rotational speed is produced by this arrangement. For example with a shaft diameter of 0.75 inches and a 6 inch diameter drum, an 8:1 step-up ratio is possible.

The drum 66 also has a centrally located pulley portion 78. Specifically, the pulley portion 78 has a substantially cylindrical belt running surface 80 which is configured with a series of alternating V-shaped grooves and peaks to accommodate the commonly used polyvee type flat belt 82 shown in FIGS. 1-3. The pulley 20 on the engine crankshaft 18 is also so configured. To further increase the step-up ratio, the diameter of pulley 20 is twice the diameter of pulley 78. Resultantly, the step-up ratio of the drum friction drive is doubled to 16:1. Thus, at 750 RPM engine idle, the air pump rotation is 12,000 RPM. At a wide open throttle engine speed of 5600 RPM, the air pump rotation is almost 90,000 RPM.

As best shown in FIGS. 1 and 3, the drum 66 is mounted on an end 84' of an arm 84. Specifically, a fastener 86 extends through a central bearing support member 88 into an elongated boss 90 attached to the arm by a weld 92. A spacer sleeve member 94 encircles member 88 and engages an annular bearing 96. This permits the drum to freely rotate on the arm 84. The other end 84" of arm 84 is pivotally attached to the surface 46 of bracket 40. Specifically, the arm portion 84" has a boss portion 98 attached thereto by a weld 100. A fastener 102 extends through a central bearing support member 104 and into a threaded portion 106 of the bracket portion 46. A spacer sleeve member 108 encircles member 104 and engages the inside surfaces of a pair of annular bearings 110', 110". This maintains the arm true (normal) to the plane of the bracket portion 46 and allows the arm 84 with the drum 66 thereon to pivot about the axis of fastener 102.

As seen in FIG. 1, the drum member 66 and crankshaft 18 are operatively connected by belt 82. Specifically, the belt 82 is drawn about pulley 20 of crankshaft 18 from a pulley 112 on a shaft 114 of the engine air conditioning compressor (not visible). The belt 82 next passes from a pulley 116 on a shaft 118 of the engines power steering pump (not visible). The belt 82 next passes under an idler pulley 120 on a shaft 122. The belt 82 next passes about pulley 56 on the shaft 58 of the alternator 48. The belt 82 next passes about the pulley 78 of drum member 66.

Figure 4:
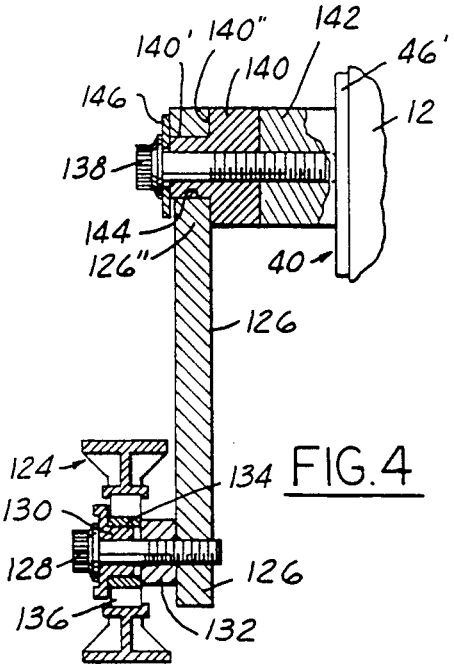

A movable belt tensioning pulley 124 is positioned between the water pump pulley 24 and the drum member pulley 78. As perhaps best seen in FIG. 4, the pulley 124 is mounted on the end 126' of a tensioner arm 126. Specifically, a fastener 128 extends through a central bearing support member 130 and spacer member 132 into the end 126' of arm 126. A sleeve member 134 encircles the member 130 and engages the inside of a bearing 136 so that the pulley can rotate freely on the arm 126.

Likewise, the opposite end 126" of arm 126 is pivotally attached to the corner portion 46' of bracket 40 and the engine block 12. Specifically, a fastener 138 extends through central spacer members 140, 142 and into a threaded portion of the engine block 12. The spacer member 140 has a cylindrical bearing surface 140' and the end portion 126" has a bore 144 through which the spacer extends. Spacer 140 also has a shoulder 140" against which the arm portion 126" seats. A washer member 146 is secured against the end 126" by the fastener 138. The spacer member 142 bears against the corner portion 40" of the bracket 40. Thus, the bracket 40 is pressed against the engine block 12 when the fastener 138 is tightened. This arrangement permits the tensioner arm 126 and the pulley 124 thereon to freely pivot about the axis of the fastener 138.

The purpose of the tensioning device is to tighten the endless belt 82 about the pulleys 20, 24, 56, 78, 112, 120 and 124. Referring again to FIG. 1, it is clear that the belt can be so tightened by applying a force to cause clockwise movement of the arm 126. A compression type coil spring 148 is positioned between the end 126' of arm 126 and a mounting pad 150 extending from the engine block 12. Formations 152 secure the spring 148 and center it.

Figure 6:
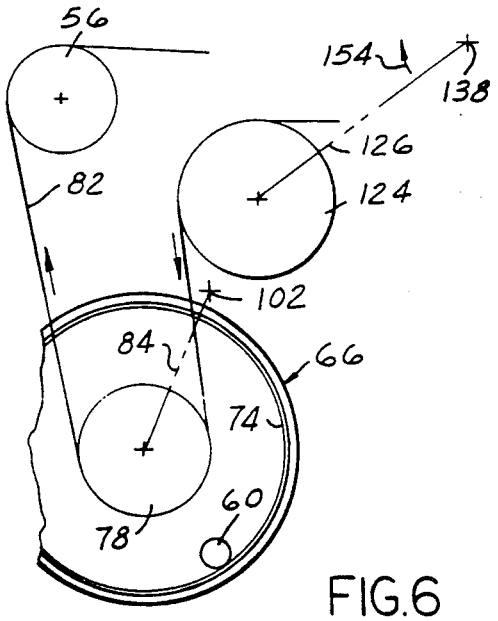

By reference to FIG. 6, it can be seen that the clockwise bias 154 created by the spring on the arm 126 transmits through the belt 82 a clockwise bias to the arm 84. This creates a frictional force F between the interior track 74 of drum 66 and the shaft end 60. Resultantly, the frictional force F is sufficient to transmits necessary driving force from the drum to the shaft. It should be noted that with increased engine speed, the tension forces on the belt 82 increase. This produces an upward force exerted by the belt 82 on the drum pulley 78 to augment the spring's force on the arm 126. Resultantly, this advantageously increases the contact frictional force F between the track 74 and shaft 60 as engine speed increases.

Although a single embodiment of the invention has been described in detail and illustrated, other embodiments can be contemplated which fall within the scope of the following claims to the invention.

I claim:

1. In association with an internal combustion engine with a crankshaft, a high speed drive mechanism for rotating an air pump, the drive mechanism being operatively connected to the crankshaft for rotation therewith during engine operation, the air pump including a rotatable shaft with an exposed end portion adapted to be rotatively driven for operation of the air pump at relatively high speeds relative to the speed of the engine crankshaft, the drive mechanism including a drum member having an end wall portion and a cylindrically tubular outer wall portion supported for rotation about an axis central to the cylindrically tubular outer wall portion, the outer wall portion forming a circular track with a diameter several times larger than the diameter of end portion of the pump shaft, the drum member and the end of the pump shaft positioned relative to one another with the end of the shaft engaging the circular track in frictional driving relation, whereby rotation of the drum member by the crankshaft rotates the pump shaft at a higher speed determined by the ratio of drum diameter to shaft diameter.

2. The improved drive mechanism set forth in claim 1 in which the circular track is formed by the inner surface of the tubular portion.

3. The improved drive mechanism set forth in claim 1 in which the air pump is mounted with its shaft secured in a fixed position and the drum member is mounted so as to permit movement thereof relative to the pump shaft so that the shaft end portion and the circular track can be biased one against the other to enhance frictional driving force therebetween.

4. In combination: an internal combustion engine having a crankshaft; a high speed air pump to supply combustion air thereto; an improved drive mechanism to rotate the air pump at a rotative speed many times the speed of the engine crankshaft; the air pump having a shaft with an exposed end portion; a generally cup-shaped driving drum member with a cylindrically tubular outer wall portion defining a circular track; the air pump and drum member being positioned relative to each other so that the axes of the circular track and the pump shaft are parallel and the end portion of the shaft extends in adjacent relation to the track whereby the shaft's end portion and the drum's circular track touch one another so that rotation of the drum causes corresponding rotation of the shaft but at a higher speed determined by the ratio of the diameter of the track to the diameter of the shaft's end portion.

5. The improved drive mechanism set forth in claim 4 in which the circular track is formed by the inner surface of the tubular outer wall portion.

6. The improved drive mechanism set forth in claim 4 in which the air pump is mounted with its shaft secured in a fixed position and the drum member is mounted so as to permit movement thereof relative to the pump shaft so that the shaft end portion and the circular track can be biased one against the other to enhance frictional driving force therebetween.

7. The improved drive mechanism set forth in claim 6 in which the drum member and crankshaft are connected for rotation together by a belt extending about pulley means on the both the drum member and on the crankshaft; a belt tensioning means for tightening the belt whereby the belt extends about the pulley means on the drum member so that belt tightening either by the tensioning means or by belt speed related forces exerts a force on the drum member tending to press its circular track against the end portion of the pump shaft.

8. In combination: an internal combustion engine with a crankshaft; a first pulley attached to the crankshaft; a high speed type air pump fixedly supported by the engine, the pump having a rotative shaft with an exposed end portion; a substantially cup shaped drum member with a cylindrically tubular outer wall portion and an end wall portion; means for mounting the end wall portion relative to the engine so that the drum member may both move relative to the shaft's end portion and rotate; a second pulley attached to the drum member's end portion; belt means extending over the first pulley and the second pulley so that the drum is rotated in correspondence to the rotation of the crankshaft; the cylindrically tubular outer wall portion defining a circular track formed by the inner surface of the tubular outer wall portion; the air pump and drum member being positioned relative to each other so that the axes of the circular track and the pump shaft are parallel and the end portion of the shaft extends in adjacent relation to the track whereby the shaft's end portion and the drum's circular track touch one another so that rotation of the drum causes corresponding rotation of the shaft but at a higher speed determined by the ratio of the diameter of the track to the diameter of the shaft's end portion.

9. The improved drive mechanism set forth in claim 8 in which the air pump is mounted with its shaft secured in a fixed position and the drum member is mounted so as to permit movement thereof relative to the pump shaft so that the shaft end portion and the circular track can be biased one against the other to enhance frictional driving force therebetween.

10. The improved drive mechanism set forth in claim 8 in which a means is provided to tighten the belt; the belt is wrapped sufficiently about the second pulley so that belt tightening by the tensioning means and by belt speed related forces thereon generates a force on the drum member tending to press its circular track against the end portion of the pump shaft.

* * * * *